United States Patent [19]

Divers et al.

[11] Patent Number: 4,494,894

[45] Date of Patent: Jan. 22, 1985

[54] EXTENSIBLE BRATTICE SUPPORT SYSTEM FOR MINE FACE VENTILATION

[75] Inventors: Edward F. Divers; John C. Lascola; Robert G. Behers, all of Pittsburgh, Pa.

[73] Assignee: The United States of America as represented by the Secretary of the Interior, Washington, D.C.

[21] Appl. No.: 473,294

[22] Filed: Mar. 8, 1983

[51] Int. Cl.[3] ..... E21F 1/14

[52] U.S. Cl. ..... 405/290; 98/50; 299/12; 405/132

[58] Field of Search ..... 405/132, 288, 290; 98/50; 299/12

[56] References Cited

U.S. PATENT DOCUMENTS

| | | | |
|---|---|---|---|
| 1,766,324 | 6/1930 | Berner | 98/50 |
| 3,715,969 | 2/1973 | Burgess | 98/50 |
| 3,972,272 | 8/1976 | Bagby | 98/50 |
| 4,157,204 | 6/1979 | Kissell et al. | 299/12 X |
| 4,282,802 | 8/1981 | Divers et al. | 299/12 X |
| 4,440,070 | 4/1984 | Baker et al. | 98/50 |

*Primary Examiner*—David H. Corbin

*Attorney, Agent, or Firm*—Thomas Zack; Donald A. Gardiner

[57] ABSTRACT

A mobile support system for an underground mine brattice curtain which extends the ventilation control of a conventional line brattice. Three embodiments are disclosed for the support system utilizing different fulcrums. In the preferred embodiment, the support's fulcrum is made up of two identical spaced semicircular skid plates which engage the floor and rockably support a first inclined rigid beam. This first beam is pivotally attached to a cantilevered generally horizontal roof engaging upper support at its inby side and has a foot engaging section on its outby side. A second rigid beam extends upwardly from the first beam towards the outby side of the upper support and is pivotally attached to the first beam. The other end of the second beam is a free end which can engage an indexing member on the lower outby end of the upper support. An impervious air curtain depends from the upper support along its length and along with the upper support can be moved to engage the roof. The floor engaging fulcrums in the two other embodiments are either two spaced circular plates or a conventional roof jack.

9 Claims, 3 Drawing Figures

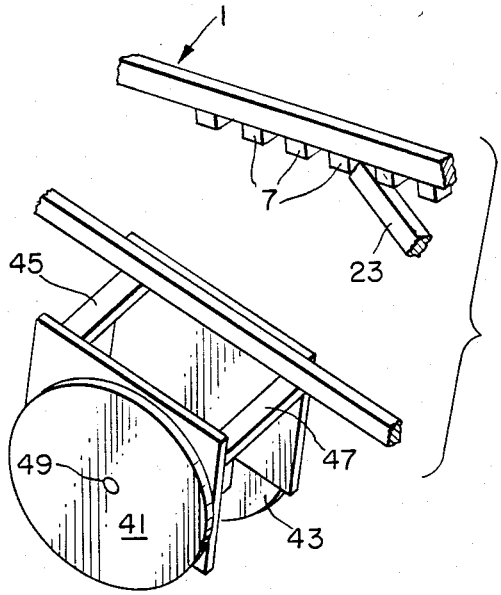
FIG. 2.
FIG. 3.
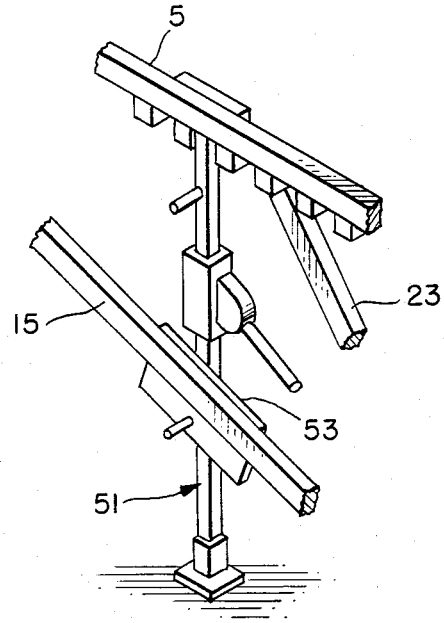

EXTENSIBLE BRATTICE SUPPORT SYSTEM FOR MINE FACE VENTILATION

BACKGROUND OF THE INVENTION

This invention disclosed herein is a ventilation control device used in underground mining operations.

DESCRIPTION OF THE PRIOR ART

Underground mine face ventilation devices which utilize extensions of a line brattice are well known. Examples of such devices can be found in U.S. Pat. Nos. 4,282,802 (E. F. Divers et al), and 4,157,204 (F. N. Kissell et al). One of the critical distances to be maintained is that to which the conventional brattice can be extended without exposing mine personnel to unsupported roof sections. Normally, as the material extraction process takes place, miners may be tempted to work in dangerous unsupported roof locations to extend the ventilation brattice. What we have done by this invention is provide a means of extending conventional brattice, 20 feet or more in length without exposing mine personnel to the dangers of unsupported roof sections.

Three embodiments are disclosed which allow the conventional line brattice to be extended when used in conjunction with conventional exhaust face ventilation. Essentially, these embodiments provide a movable and pivotted structural frame support for the cantilevered air curtain. In the preferred embodiment, the frame support is made up of an upper support member from which the curtain is cantileverally supported and extends downwardly. Several height adjustment cogs are provided on the lower side of this upper support member. An inclined first rigid support member is pivotally attached to the lower end of the upper support. A semicircular ground supported skid engages this inclined support and acts as a fulcrum therefor. Extending upwardly and pivotally attached to the first support member at its lower end is a second inclined rigid support member. The upper end of this second support member can selectively engage the height adjustment cogs of the upper support member. In one alternate embodiment, the semicircular ground support fulcrum is replaced by a circular chariot-type wheel, and in the other embodiment by a fixed conventional roof jack.

SUMMARY OF THE INVENTION

An extension for a conventional line brattice used in an underground mining operation. The extension is made up of an upper cantilevered support frame member assembly from which a brattice curtain depends. Supporting this upper assembly are two separate inclined rigid support members. Towards the cantilevered inby side, the upper assembly is pivotally attached to the first of these rigid supports This first support extends over a movable fulcrum to where it is pivotally attached to the second upwardly extending second support. The end of the first support is engageable by the downward foot pressure of an operator to cause the inby side of the first support—and its attached upper support—to vertically rise. The other end of the second support also engages the upper support on a selective basis to adjust and fix its height as the operator pivots the first support.

DESCRIPTION OF THE DRAWINGS

FIG. 2 shows a first alternate fulcrum used in place of the fulcrum of FIG. 1.

FIG. 3 depicts a second alternate embodiment of the FIG. 1 fulcrum.

DESCRIPTION OF THE PREFERRED EMBODIMENT

Figure 1:
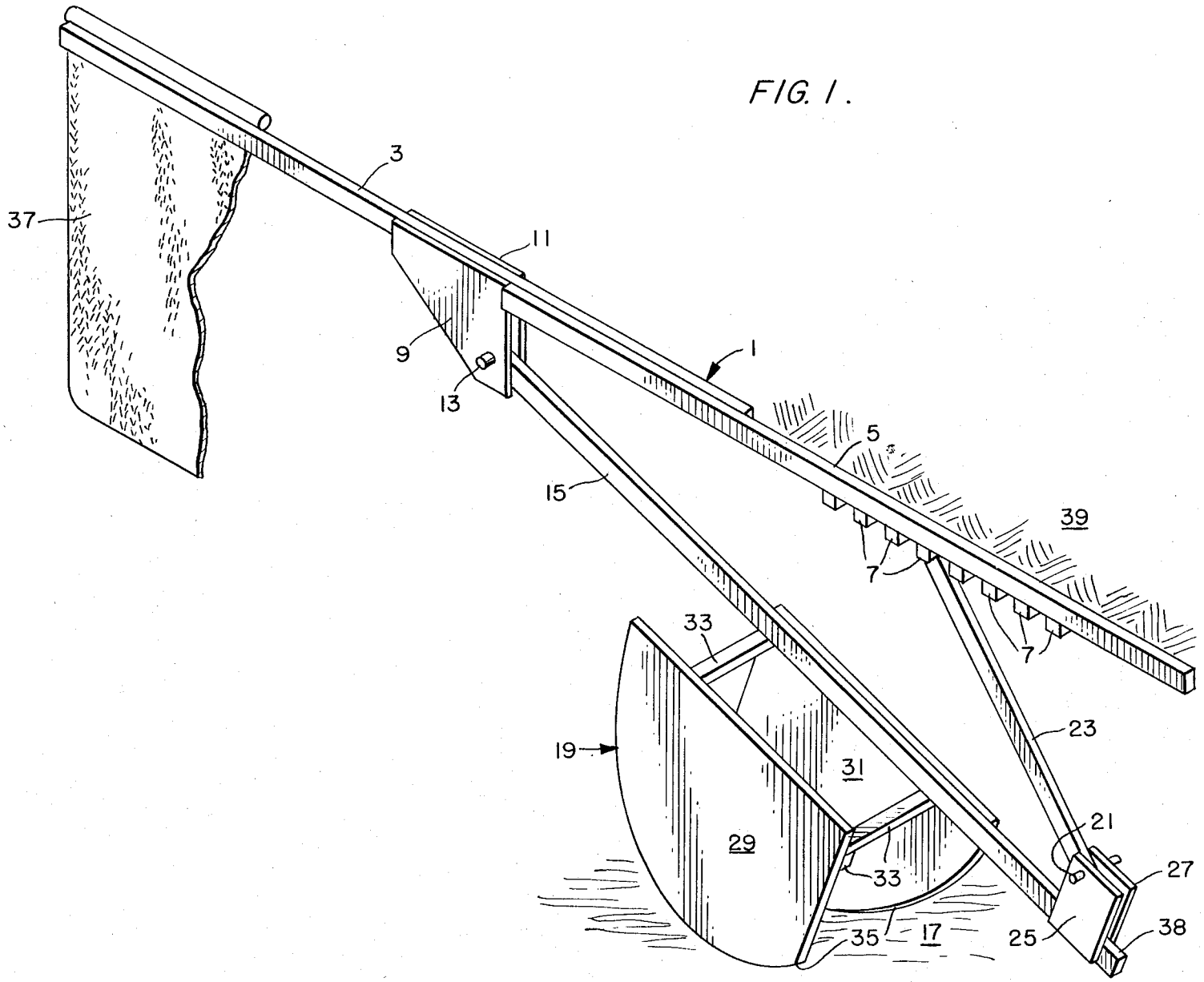
FIG. 1 is an isometric view of the preferred embodiment of our invention with the brattice curtain cutaway.

The preferred embodiment of FIG. 1 is depicted in situ in an underground mine The upper support assembly 1 is made up of one or more rigid beams. Two support beams are shown with the cantilevered inby side beam 3 being rigidly fixed to the outby support beam 5. A series of height adjustment cogs 7 formed on the underside of the outby beam allows for its selective adjustment as will be described hereinafter. On the inby support beam near where the two support beams join, two depending plates 9 and 11 form a gusset into which a pivot rod 13 extends. This pivot rod joins the first rigid support beam 15 to the upper support member and acts as support for its cantilevered end. Engaging the mine floor 17 is the fulcrum support 19 for the first beam and its attached assembly. Near the end of the first beam a gusset and pivot rod 21 joint attaches a second inclined rigid support beam 23. This gusset, like the inby gusset, is formed by two parallel plates 25 and 27, which extend upwardly from the beam 15.

The preferred embodiment for the rockable fulcrum 19 is illustrated in FIG. 1. It is made of two identical semicircular skid plates 29 and 31 joined together facing in opposite directions by three identical spaced transverse rigid beams 33. Normally the straight rigid beam 15 rests on the two upper beams 33 to allow the fulcrum to rock on its outer rounded ground engaging edges 35. An air impervious layer of brattice cloth material 37 is attached to the upper support 1 and depends therefrom. This material extends the total length of the support but has been cut away in FIG. 1 for ease in understanding.

Part of the first support beam extends past the outby gusset to form a stepping portion 38. To work the invention, the operator applies downward foot pressure thereon to cause an upward spring-like deflection of the beam 15 on its fulcrum. Simultaneously with the application of foot pressure, the operator lifts the outby end of the support assembly 1 and the upper free end of beam 23 and places it into the tightest cog 7 thereby abutting the upper side of curtain 37 and its upper support firmly into the mine roof 39. Thus, depending on the combined length of the joined upper support beams (typically 15-22 feet), the operator is not required to enter into an unsuported roof section—to the left or inby side in FIG. 1—in order to extend the mine ventilation brattice. In this manner, methane or other undesirable gases are drawn in a controlled manner from the mine working face or inby side by the mine ventilation system to decrease the possibility of an explosion or other safety hazard.

FIGS. 2 and 3 employ the same elements as in FIG. 1 except that in each figure the FIG. 1 fulcrum 19 has a new fulcrum in its place. For ease in understanding, only the fulcrum and adjacent parts are illustrated, it being understood all of the other FIG. 1 elements would be well with both other figures. The new fulcrum 19 of FIG. 2 consists of two identical circular plates 41 and 43 spaced from each other by two beams (45 and 47) and a center steel rod 49. Like the preferred embodiment, the first beam 15 (shown in a cut away view) engages the transverse support beams 45 and 47 of the FIG. 2 embodiment to allow the raising of the upper support assembly 1. As before, the placing of the end of the second beam 23 in the appropriate cog 7, causes the upper portion of the curtain to engage the mine's roof and provide the extension.

In FIG. 3 there is illustrated a third, less preferred, embodiment of the FIG. 1 beam fulcrum. Essentially the fulcrum of this embodiment is a conventional roof jack 51. The jack engages the floor on one end, the roof on the other end, and the first support beam 15 at pivot connection 53 towards its lower end. Once the upper support is raised to its desired height, the second beam 23 is inserted into the locking cog and the curtain engages the mine's roof.

From the foregoing description, it should be clear that our extensible brattice support system is typically used in conjunction with a conventional stationary line brattice curtain as is the case in U.S. Pat. No. 4,282,802 previously mentioned. Thus, it could overlap the front end of such a stationary curtain. It would thereby act to extend the benefit of the air control brattice curtain nearer the unsupported working area. Other structures and variations are also possible. None, however, should be used to change the scope and spirit of our support system which is to be limted only by the claims that follow.

We claim:

1. A mobile extensible brattice support system for use with an underground mine ventilation system comprising:

an upper elongated support assembly having a cantilevered inby end and an outby end extending in the same general direction as the directed flow of air, said assembly having height adjustment indexing members on its lower side nearer the outby end thereof;

an air impervious depending curtain extending along the longitudinal extent of said assembly in the direction of directed air flow;

a first rigid inclined support member pivotally joined to said first member at one end, said first member having a lower foot engaging section near its other end;

a second rigid inclined support member pivotally joined to said first member at one end and having a free end on its other end engageable with said assembly's indexing members; and a movable mine floor engaging fulcrum to support said first rigid member whereby upon the application of a downward foot pressure on the first member's foot engaging section the free end of the second member may be inserted into the assembly's indexing member to raise and fix the assembly and its depending curtain into engagement with the mine's roof.

2. The brattice system of claim 1 wherein a portion of said curtain extends above the upper support assembly to enhance the air seal against the mine roof.

3. The brattice system of claim 1 wherein said fulcrum is a semicircular-shaped skid made of two rigid spaced joined plates.

4. The brattice system of claim 1 wherein said upper assembly's height adjustment indexing members comprise a series of separated cogs extending along the underside of the assembly nearer its outby end.

5. The brattice system of claim 1 wherein said upper support assembly has two joined rigid elongated members with the first support member being pivotally joined to the assembly's member near the assembly's inby end by a gusset and joining rod member.

6. The brattice system of claim 1 wherein said first and second support members are pivotally joined to each other by a gusset and joining rod member.

7. The brattice system of claim 1 wherein said fulcrum is a circular-shaped skid made of two spaced rigid plates joined together.

8. An extensible brattice support system for use with an underground mine ventilation system comprising:

an upper elongated support assembly having a cantilevered inby end and an outby end and extending in the same general direction as the directed flow of air;

vertical height adjustment means for moving said upper support assembly with respect to the mine floor, said means providing for the incremental vertical adjustment of the assembly;

an air impervious depending curtain extending along the longitudinal extent of said assembly in the direction of directed air flow;

a first rigid inclined support member pivotally joined to said assembly at one end, said first member having a lower foot engaging section near its other end; and a second rigid inclined support member pivotally joined to said first member at one end and engageable with said support assembly at the other end whereby the support assembly and its depending curtain may be vertically adjusted to engage the mine roof therealong.

9. The support system of claim 8 wherein the vertical height adjustment means is a roof support jack extending between the mine's floor and roof.

* * * * *